United States Patent [19]

Broeils

[11] Patent Number: 4,462,122

[45] Date of Patent: Jul. 31, 1984

[54] RAISED SUPERIMPOSED TOILET SEAT AND SECURING CLAMP

[75] Inventor: John Broeils, Wycoff, N.J.

[73] Assignee: Maddak, Inc., Pequannock, N.J.

[21] Appl. No.: 554,785

[22] Filed: Nov. 23, 1983

[51] Int. Cl.[3] ..... A47K 13/00

[52] U.S. Cl. ..... 4/239; 4/235

[58] Field of Search ..... 4/239, 234, 235, 237, 4/661, 483; D23/53, 71; 297/216, 310, 253, 250, 252, 257, 234, 232

[56] References Cited

U.S. PATENT DOCUMENTS

| | | | |
|---|---|---|---|
| D. 190,555 | 6/1961 | Weidner | D4/5 |
| D. 237,887 | 12/1975 | Landsberger | D23/2 |
| D. 242,457 | 11/1976 | Landsberger | 4/239 X |
| 762,512 | 6/1904 | Busse | 4/239 |
| 796,276 | 8/1905 | Wolff | 4/239 |
| 1,147,328 | 7/1915 | Knight | 4/239 |
| 1,163,628 | 12/1915 | Gibson | 4/239 X |
| 1,355,669 | 10/1920 | Henry | 4/239 |
| 1,953,855 | 4/1934 | Headworth | 4/239 X |
| 1,958,276 | 5/1934 | McCandlell | 4/239 |
| 1,998,854 | 4/1935 | Steele et al. | 4/239 |
| 2,255,272 | 9/1941 | Rasmussen | 4/239 |
| 2,332,658 | 10/1943 | Muller | 4/239 |
| 3,364,505 | 1/1968 | Palmier | 4/239 |
| 3,490,082 | 1/1970 | Murcot | 4/239 |
| 4,214,323 | 7/1980 | Thomas | 4/239 X |
| 4,381,568 | 5/1983 | Brown | 4/239 |

*Primary Examiner*—Henry K. Artis

*Attorney, Agent, or Firm*—Anthony F. Cuoco

[57] ABSTRACT

A raised toilet seat is superimposed upon the bowl of a conventional toilet. A clamp has a section which fits into a space provided when the lid and the seat of the conventional toilet are lifted, and has another section which fits around the back end of the raised superimposed toilet seat and engages the underside thereof, whereby the raised superimposed toilet seat is secured to the conventional toilet.

14 Claims, 5 Drawing Figures

RAISED SUPERIMPOSED TOILET SEAT AND SECURING CLAMP

BACKGROUND OF THE INVENTION

Raised toilet seats which are superimposed upon conventional toilets are an indispensable aid for invalids and others who experience difficulty in sitting on and raising from a conventional toilet seat. The raised superimposed toilet seat is disposed directly on the bowl of the conventional toilet and affords complete comfort to the user as is desired. Toilet seats of the type contemplated are described, for example, in U.S. Pat. Nos. Des. D237,887 and D242,457 issued to Kurt Landsberger on Dec. 2, 1975 and Nov. 23, 1976, respectively.

Prior to the present invention these seats have been used with conventional toilets as aforenoted without any clamping device to securely mount the seats to the conventional toilets. While this arrangement is sufficient in many situations, it is often required, to accommodate the capabilities of the user, to clamp the raised superimposed seat to the conventional toilet to secure the seat thereto and to otherwise provide a degree of stability to the seat when it is being used. The present invention accommodates this requirement in a simple yet satisfactory manner.

Accordingly, it is an object of the present invention to provide a raised toilet seat of the type which is superimposed upon a conventional toilet in combination with a clamp for securing the raised superimposed toilet seat to the conventional toilet.

SUMMARY OF THE INVENTION

A raised toilet seat is superimposed upon the bowl of a conventional toilet, with the lid and seat of the conventional toilet in a lifted position, whereby a space is provided between the lifted seat and lid and the section of the toilet connecting the bowl and water tank to the toilet. A clamp is arranged to fit into the space so as to be retained therein, and to curve around the back of the raised superimposed toilet seat to terminate adjacent the underside of the seat. The underside of the seat has a recess therein which receives a pin-like protrusion on the adjacent clamp. The cooperative action of the clamp with the raised superimposed seat is effective for securing said seat to the conventional toilet.

DETAILED DESCRIPTION OF THE INVENTION

Figure 1:
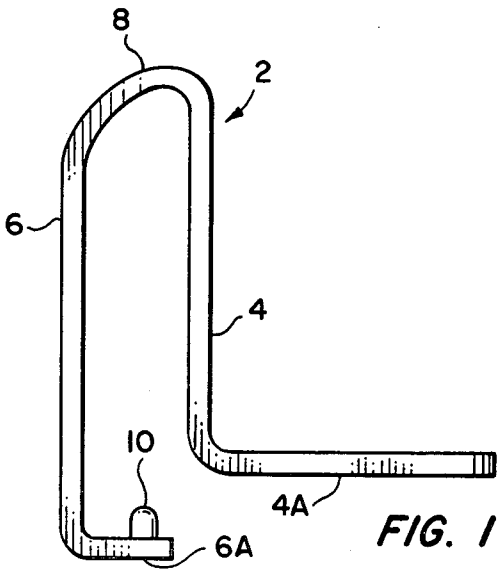
FIG. 1 is a diagrammatic side view of a clamp contemplated by the invention.
Figure 2:
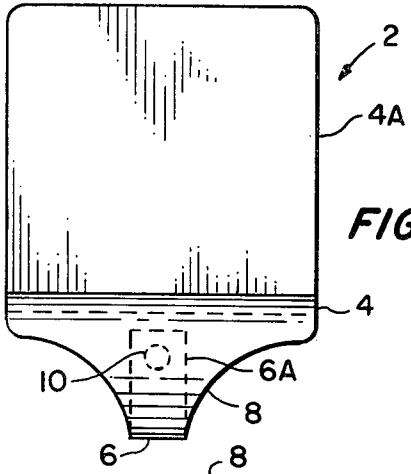
FIG. 2 is a diagrammatic top view of the clamp, the side view of which is shown in FIG. 1.
Figure 3:
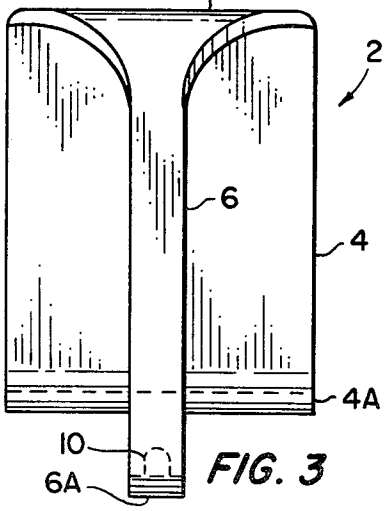
FIG. 3 is a diagrammatic front view of the clamp the side views and top views of which are shown in FIG. 1 and 2, respectively.

With reference to FIGS. 1, 2 and 3 a clamp is designated generally by the numeral 2. Clamp 2 has an L-shaped member 4 and an L-shaped member 6. L-shaped members 4 and 6 are in spaced relation each to the other, and are joined by a contoured member 8. L-shaped members 4 and 6 and contoured member 8 form an integral clamp 2.

The arrangement is such that L-shaped members 4 and 6 extend substantially parallel to each other. L-shaped member 4 is shorter than L-shaped member 6 so that the base 4A of L-shaped member 4 is above the base 6A of L-shaped member 6. Base 6A has a pin-like member 10 centrally disposed near the end thereof and extending normal from the base as will be readily seen from FIGS. 1, 2 and 3.

L-shaped member 4 including its base 4A are relatively wide, while L-shaped member 6 including its base 6A are relatively narrow as will be readily seen from FIGS. 2 and 3. Base 6A extends in the same direction as base 4A, but not beyond the beginning of L-shaped member 4.

Figure 5:
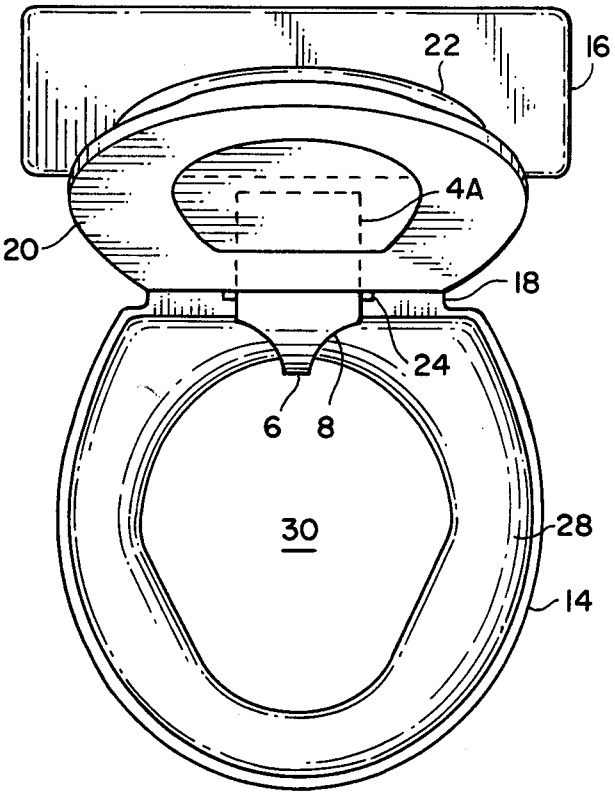
FIG. 5 is a diagrammatic top view with respect to the side view of FIG. 4.
Figure 4:
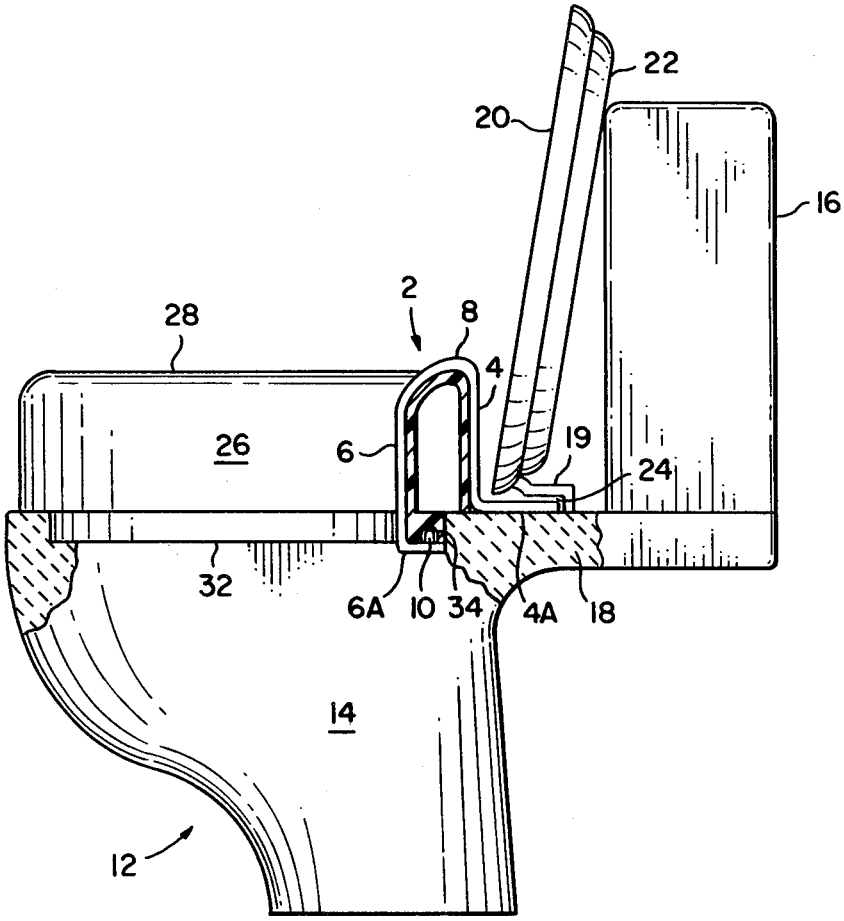
FIG. 4 is a diagrammatic, partially sectioned side view of a raised toilet seat superimposed upon a conventional toilet bowl and clamped in the superimposed position by the clamp shown in FIGS. 1, 2 and 3.

With reference now to FIGS. 4 and 5, a conventional toilet is designated by the numeral 12 and has a bowl 14, a water tank 16, and a connecting section 18 which connects bowl 14 and tank 16. A seat 20 and a lid 22 are suitably coupled to connecting member 18 as by a hinge arrangement 19 or the like (symbolically shown) so as to be lowered and lifted relative to toilet bowl 14. When seat 20 and lid 22 are in the lifted position, that is resting against tank 16 as shown in FIG. 4, a space 24 is provided between hinge arrangement 19 and connecting section 18. This space is used in association with clamp 12 so as to firmly secure a raised toilet seat 26 in a superimposed position on toilet bowl 14 as will next be described. Only as much of conventional toilet 12 is shown and described as is necessary to understand the present invention.

Raised toilet seat 26 may be of various configurations such as described in the aforenoted U.S. Pat. Nos. Des. D237,887 and D242,457 and is shown in FIGS. 4 and 5 in its simplist form for purposes of describing the invention. It will suffice to say for present purposes that the top 28 of raised toilet seat 26 is suitably contoured and rests on bowl 14, and has a through opening 30 disposed substantially central to seat 26 as best shown in FIG. 5.

Toilet seat 26 has a lower portion 32 (FIG. 4) which is smaller in diameter than the top of the seat so as to fit within toilet bowl 14. In modifying seat 26 for the purposes of the invention the underside of lower seat portion 32 carries a recess 34 for receiving pin-like member 10 of base portion 6A of L-shaped member 6 as will hereinafter be more specifically described.

Raised seat 26 is superimposed upon bowl 14, with lower portion 32 of the seat resting within the bowl as shown in FIG. 4. Clamp 2 is oriented so that base 4A of L-shaped member 4 is substantially horizontal as is base 6A of L-shaped member 6.

With the clamp thus oriented, base 4A of L-shaped member 4 is disposed within space 24 between hinge arrangement 19 and connecting member 18 so as to be captured in said space.

L-shaped portion 4 of clamp 2 extends upwardly adjacent the rear exterior portion of raised seat 26, with contoured member 8 of clamp 2 curving around and adjacent the rear top portion of raised seat 26 so that L-shaped member 6 extends downwardly within opening 30 adjacent the interior of the rear portion as shown in FIGS. 4 and 5. L-shaped member 6 is sized so as to extend below lower portion 32, with base 6A adjacent the underside thereof, so that pin-like member 10 engages recess 34.

With the arrangement shown—i.e., base 4A of L-shaped portion 4 of clamp 2 captured in space 24, pin-like member 10 on base 6A of L-shaped portion 6 engaging recess 24 and contoured member 8 curving around the top of seat 26, it will be seen that seat 26, superimposed upon toilet 12 is firmly secured thereto so as to preclude movement thereof as might otherwise occur upon a user lowering or lifting the body relative to the raised seat.

Clamp 2 may be molded of a smooth, easily cleaned strong polyethylene material so as to conform to the material of seat 26, and to thereby provide little encumberance to the user.

It will thus be seen from the aforegoing description of the invention that a raised superimposed toilet seat and securing clamp have been provided in combination, whereby when the raised seat is superimposed upon the bowl of a conventional toilet and the seat and the lid of the conventional toilet are in a raised position against the water tank of the toilet, the clamp is in cooperative relation with the raised superimposed seat so as to firmly secure said seat in a superimposed position to the conventional toilet.

The arrangement described maximizes user comfort and stability and thus enhances the use of raised superimposed toilet seats by elderly persons and others who suffer immobilizing infirmaties to the extent that they are unable to use conventional toilet seats.

With the aforegoing description of the invention in mind reference is had to the appended claims for the scope of the invention.

What is claimed is:

1. For use with a toilet of the type having a bowl, a water tank, a section connecting the bowl to the tank, a seat and a lid, means coupling the seat and lid to the connecting section so that the seat and lid can be lifted relative to the bowl, with a space being provided between the coupling means and the connecting section when said seat and lid are lifted to rest against the tank, in combination, a raised seat superimposed on the toilet and a clamp for securing said raised superimposed seat to the toilet, characterized by:

the raised seat including an upper portion which rests on the bowl, a lower portion which fits into the bowl and having a recess on the underside thereof; and an opening extending through the upper and lower portions;

the clamp including a pair of substantially L-shaped members in spaced relation and joined by a contoured member for providing an integral clamp;

the base of one of the substantially L-shaped members being received in the space between the coupling means and the connecting section so as to be captured therein, with said one L-shaped member extending adjacent to and upwardly external to the back of the raised superimposed seat;

the contoured member extending adjacent to and around the upper portion of said back, with the other of the L-shaped members extending adjacent to and downwardly internal to the back of the opening in the raised superimposed seat;

the base of the other L-shaped member extending adjacent the underside of the lower portion of the raised superimposed seat and carrying a pin-like member which engages the recess on said underside; and the pair of L-shaped members and the contoured member thereby being in cooperative relation with the raised superimposed seat and the toilet to secure said seat to the toilet.

2. For use with a toilet of the type having a bowl, a water tank, a section connecting the bowl to the tank, a seat and a lid, means coupling the seat and the lid to the connecting section so that the seat and lid can be lifted relative to the bowl, with a space being provided between the coupling means and the connecting section when said seat and lid are lifted to rest against the tank, in combination a raised seat superimposed on the toilet and a clamp for securing said raised superimposed seat to the toilet, characterized by:

the raised seat including an upper portion which rests on the bowl, a lower portion which fits into the bowl and having a recess on the underside thereof, and an opening extending through the upper and lower portions;

the clamp including first means for engaging the space between the coupling means and the toilet, said first means extending adjacent to and upwardly external to the back of the raised superimposed seat, second means curving adjacent to and around the upper portion of said back, and third means extending adjacent to and downwardly internal in the opening in the raised superimposed seat, and engaging the recess on the underside of the lower portion of said seat; and the first, second and third means thereby being in cooperative relation with the raised superimposed seat and toilet to secure said seat to the toilet.

3. The combination described by claim 2, wherein the first means is characterized by:

a first substantially L-shaped member having a base for engaging the space between the coupling means and the connecting section, and having a section extending substantially normal to the base, adjacent to and upwardly external to the back of the raised superimposed seat.

4. The combination described by claim 3, wherein the second means is characterized by:

a contoured member integral with the extending section of the first L-shaped member and curving adjacent to and around the upper portion of said back.

5. The combination described by claim 4, wherein the third means is characterized by:

a second substantially L-shaped member having a section integral with the contoured member and extending adjacent to and downwardly internal to the opening in the raised superimposed seat, and having a base substantially normal to said extending section and adjacent the underside of the lower portion of said seat, said base having means for engaging the recess on said underside.

6. The combination described by claim 5, wherein the means for engaging the recess on said underside is characterized by:

a pin-like member carried by the base.

7. The combination described by claim 5, further characterized by:

the first and second L-shaped members being in spaced relation, with the bases of said members extending toward the back of the raised superimposed seat; and the base of the second L-shaped member terminating ahead of the extending section of the first L-shaped member.

8. The combination described by claim 1, further characterized by:

the bases of the one and the other L-shaped members extending toward the back of the raised superimposed seat; and the base of the other L-shaped member terminating ahead of the base of the one L-shaped member.

9. For use with a toilet of the type having a bowl, seat means, means coupling the seat means to the toilet so that the seat means is liftable relative to the bowl, with a space being provided between the coupling means and the toilet when the seat means is lifted, in combination, a raised seat superimposed on the toilet, characterized by:

the raised seat including an upper portion which rests on the bowl, a lower portion which fits into the bowl and having a recess on the underside thereof, and an opening extending through the upper and lower portions;

the clamp including first means for engaging the space between the coupling means and the toilet, said first means extending adjacent to and upwardly external to the back of the raised superimposed seat, second means curving adjacent to and around the upper portion of said back, and third means extending adjacent to and downwardly internal in the opening in the raised superimposed seat, and engaging the recess on the underside of the lower portion of said seat; and the first, second and third means thereby being in cooperative relation with the raised superimposed seat and the toilet to secure said seat to the toilet.

10. The combination described by claim 9 wherein the first means is characterized by:

a first substantially L-shaped member having a base for engaging the space between the coupling means and the toilet, and having a section extending substantially normal to the base, adjacent to and upwardly external to the back of the raised superimposed seat.

11. The combination described by claim 10 wherein the second means is characterized by:

a contoured member integral with the extending section of the first L-shaped member and curving adjacent to and around the upper portion of said back.

12. The combination described by claim 11 wherein the third means is characterized by:

a second substantially L-shaped member having a section integral with the contoured member and extending adjacent to and downwardly internal to the opening in the raised superimposed seat, and having a base substantially normal to said extending section and adjacent the underside of the lower portion of said seat, said base having means for engaging the recess on said underside.

13. The combination described by claim 12 wherein the means for engaging the recess on said underside is characterized by:

a pin-like member carried by the base.

14. The combination described by claim 12 further characterized by:

the first and second L-shaped members being in spaced relation, with the bases of said members extending toward the back of the raised superimposed seat; and the base of the second L-shaped member terminating ahead of the extending section of the first L-shaped member.

* * * * *